US005094068A

United States Patent [19]

Hirao

[11] Patent Number: 5,094,068

[45] Date of Patent: Mar. 10, 1992

[54] FALSE TWISTER FOR YARN

[75] Inventor: Osamu Hirao, Uji, Japan

[73] Assignee: Murata Kikai Kabushiki Kaisha, Kyoto, Japan

[21] Appl. No.: 675,484

[22] Filed: Mar. 26, 1991

[30] Foreign Application Priority Data

Apr. 9, 1990 [JP] Japan ..... 2-37932[U]

[51] Int. Cl.[5] ..... D01H 7/92; D02G 1/02

[52] U.S. Cl. ..... 57/334; 57/284; 57/285; 57/332; 57/336; 57/341

[58] Field of Search ..... 57/284–285, 57/332, 334, 336, 348, 352, 341, 280, 287

[56] References Cited

U.S. PATENT DOCUMENTS

| | | | |
|---|---|---|---|
| 3,112,600 | 12/1963 | Studdard et al. | 57/285 |
| 3,683,611 | 8/1972 | Buzano | 57/285 X |
| 3,791,130 | 2/1974 | Inuyama et al. | 57/285 |
| 4,377,932 | 3/1983 | Dammann et al. | 57/336 |
| 4,384,494 | 5/1983 | Taylor | 57/336 X |
| 4,478,037 | 10/1984 | Backer | 57/284 |
| 4,956,970 | 9/1990 | Bauer et al. | 57/334 |

*Primary Examiner*—Lenard A. Footland
*Assistant Examiner*—William Stryjewski
*Attorney, Agent, or Firm*—Spensley Horn Jubas & Lubitz

[57] ABSTRACT

A yarn false twister in which an endless belt an a first rotary member are disposed across each other to constitute a nip point at which a yarn is twisted, and a second rotary member, on which the yarn is wound after the nipping thereof so that the upstream and downstream portions of the wound yarn cross in contact with each other, is provided coaxially with the first rotary member so that the second rotary member can be rotated independently of the first rotary member.

7 Claims, 4 Drawing Sheets

FALSE TWISTER FOR YARN

FIELD OF THE INVENTION

The present invention relates to a false twister for a yarn which continuously performs twisting, thermal fixing and untwisting. The present invention more particularly relates to a false twister for a yarn which functions so that when a yarn is held at both ends thereof and then twisted between the ends, the directions of the turns of portions of the yarn on both sides of the point of the twisting differ from each other so that the yarn is untwisted continuously to the twisting.

RELATED ART STATEMENT

As a false twister for twisting yarn, a nip-type false twister which nips a yarn has been known. A twisting-belt-type false twister is a typical nip-type false twister. In the twisting-belt-type false twister, a yarn is completely nipped by two special twisting belts so that the yarn is twisted without slipping relative to the belts. As for the twisting-belt-type false twister, a wide range of numbers of twists can be set, and the untwisting tension of the yarn can be freely selected. For that reason, the twisting-belt-type false twister is most appropriate for a high-quality processed yarn. It has recently been desired that the speed of false twisting by the twisting-belt-type false twister be increased for higher efficiency and lower cost. However, the speed of false twisting is generally 600 to 800 m/min., and can be made higher than that in practical use only for a special yarn. That is because defects such as fluff (which is a state that one of the filaments of the yarn is cut off) and a non-untwisting spot (which is a state that the untwisting of the yarn is nonuniform) increase along with the rise in the speed of false twisting. Therefore, to increase the speed of false twisting, the defects need to be prevented.

A false twister shown in FIG. 6 was then proposed by the present applicant to add reverse twisting to untwisting down-stream of the twisting-belt-type false twister to assist and uniformize the untwisting, to increase the speed of false twisting without increasing the above-mentioned defects of a yarn. In the false twister shown in FIG. 6, a rotary-member-type false twister 12 for the reverse twisting is provided downstream of a twisting-belt-type false twister 11. The portion Y of the yarn, which is located upstream of the twisting-belt-type false twister 11, is subjected to Z twisting. The portion Y2 of the yarn, which is located between the twister 11 and the unit 12, is subjected to S twisting which is reverse twisting. The portion Y1 of the yarn, which is located downstream of the unit 12, is untwisted. In the twisting-belt-type false twister 11, the yarn is completely nipped by two twisting belts 11A disposed across each other and running in mutually reverse directions, so that the yarn portion Y is twisted without slipping relative to the belts. Since the yarn portion Y is nipped between the twisting belt 11A so as to be twisted, the force for the twisting does not depend on the tension of the yarn but on the contact pressure of the belts. The twisting tension T1 of the yarn upstream of the twister 11 and that T2 of the yarn downstream of the twister have mutually different values which are determined by the difference between the speed of the feed of the yarn by the twisting belts 11A and that by a first feed roller 13 and the difference between the speed of the feed of the yarn by the belts and that by a second feed roller 14. In the rotary-member-type false twisting unit 12, the yarn is wound on a rotary member, and the portions of the yarn, which are located upstream and downstream of the rotary member, cross in contact with each other, so that the yarn is twisted. Since the yarn is twisted by the unit 12 because of the self contact of the yarn, the force for the twisting depends on the tension of the yarn. When the yarn is twisted, the tension thereof decreases. The unit 12 whose twisting operation depends on the tension of the yarn twists it depending on the fluctuation in the tension, to make the tension constant. The unit 12 is provided downstream of the twister 11 so as to add the reverse twisting, to assist the untwisting, depending on the twisting tension of the yarn, to stabilize the untwisting in a high-speed processing area.

In the yarn false twister proposed by the previous invention and shown in FIG. 6, the twisting-belt-type false twister 11 and the rotary-member-type false twisting unit 12 are disposed in series with each other. For that reason, the yarn false twister has problems that a larger installation space is needed and it is more complicated to engage the yarn on the twister.

AN OBJECT AND SUMMARY OF THE INVENTION

The present invention has been made in consideration of the problems of the conventional art. Accordingly, it is an object of the present invention to provide a yarn false twister which is compact and capable of adding reverse twisting.

In the yarn false twister provided in accordance with the present device, an endless belt and a first rotary member are disposed across each other to constitute a nip point at which a yarn is twisted, and a second rotary member, on which the yarn is wound after the nipping thereof so that the upstream and downstream portions of the wound yarn cross in contact with each other, is provided coaxially with the first rotary member so that the second rotary member can be rotated independently of the first rotary member.

The first and second rotary members of the yarn false twister are provided coaxially with each other so that the members can be rotated independently of each other. The yarn is twisted at the nip point on the first rotary member, and subsequently twisted in reverse because of the self crossing of the yarn. The twisting, reverse twisting and untwisting of the yarn are continuously performed by the integrated device.

DETAILED DESCRIPTION OF PREFERRED EMBODIMENT

Figure 1:
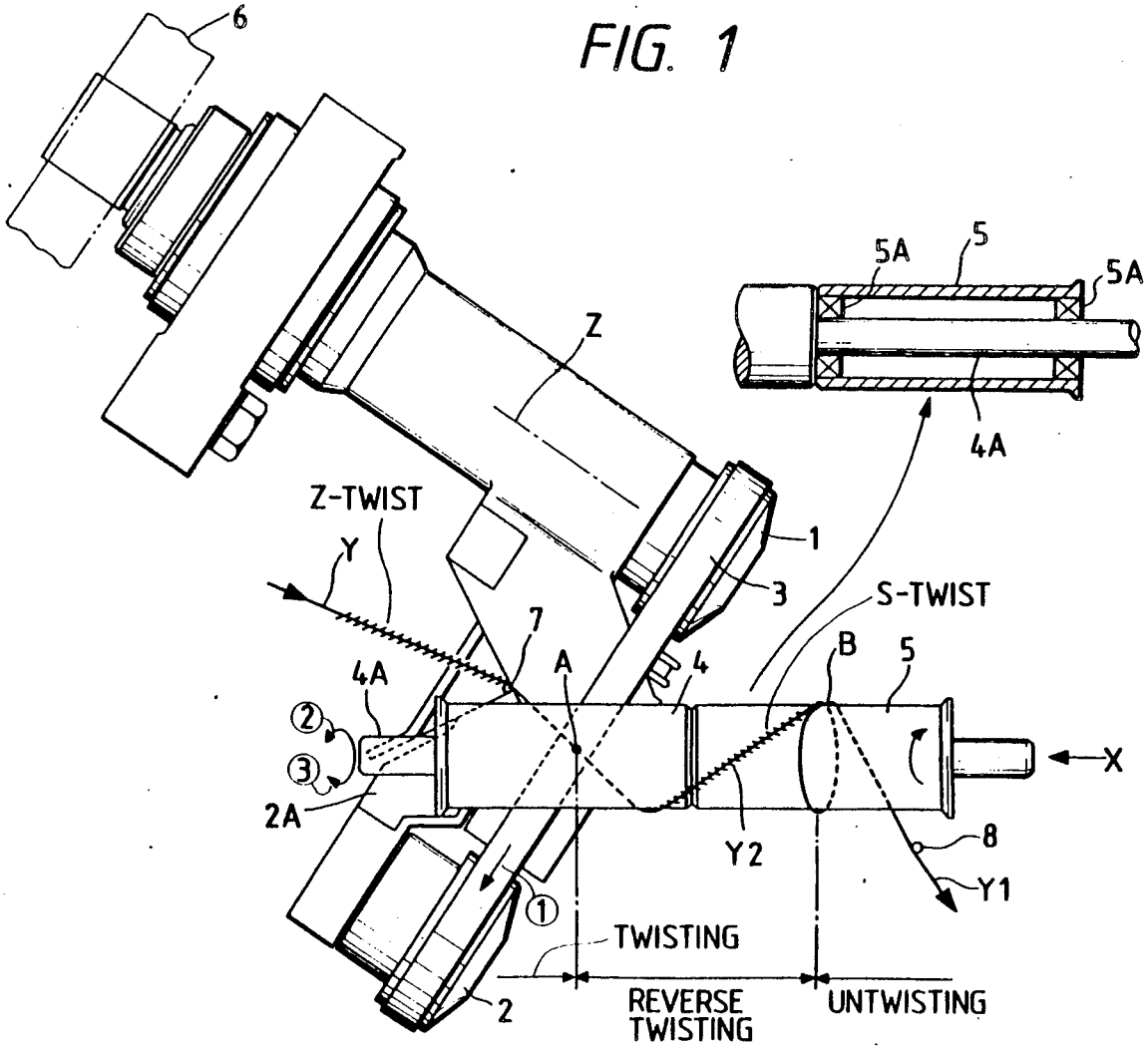
FIG. 1 is a front view of a false twister for a yarn which is an embodiment of the present invention.

An embodiment of the present invention will be hereafter described with reference to the drawing attached hereto.

Figure 2:
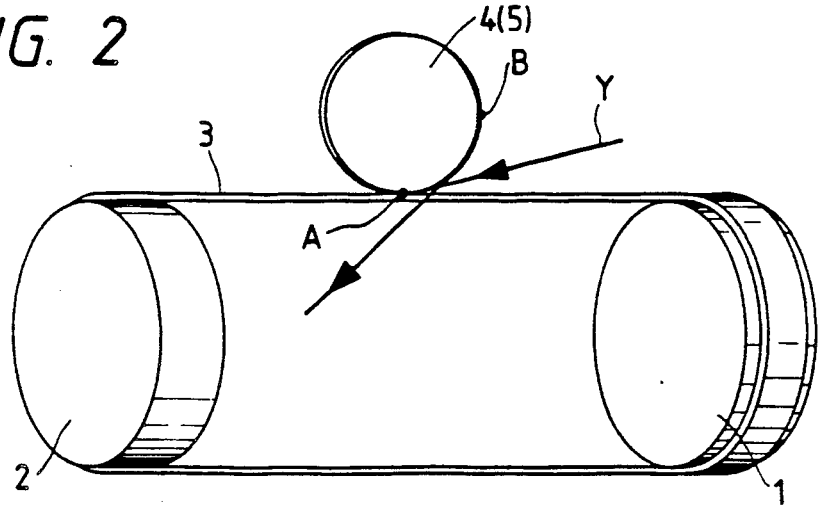
FIG. 2 is a view of the apparatus seen along an arrow X shown in FIG. 1.

FIG. 1 is a front view of an apparatus which is for tentatively twisting a yarn. FIG. 2 is a view of the apparatus seen along an arrow X shown in FIG. 1. The apparatus includes an endless belt 3 fitted on a drive pulley 1 and an idle pulley 2, a first rotary member 4 disposed across the endless belt so as to constitute a nip point A, and a second rotary member 5 disposed coaxially with the first rotary member, as shown in FIGS. 1 and 2. The endless belt 3 is supported by a mechanism which is nearly the same as one belt support mechanism of the above-mentioned twisting-belt-type false twister. An arm 2A, which supports the idle pulley 2, is urged so that the arm can be swung about a center axis Z to perform nipping with an appropriate nipping force at the nip point A or cease the nipping. The drive pulley 1 is driven through a tangential belt 6 simultaneously therewith. The first rotary member 4 is rotatably supported at the shaft 4A thereof by a being box not shown in the drawings, so that the member can rotate freely or be positively rotated by a tangential belt not shown in the drawings. If the first rotary member 4 rotates freely, it is turned in a direction ① by the endless belt 3 when the belt revolves in a direction ①. If the first rotary member 4 is positively rotated, it is turned in a direction ③ reverse to the direction ① of the revolution of the endless belt 3 when the belt is revolved in that direction. The second rotary member 5 is rotatably supported with bearings 5A on the shaft 4A of the first rotary member 4 so that the second rotary member can be rotated independently of the first rotary member. The surfaces of the first and the second rotary members 4 and 5 are provided with rubber coating, aventurine hard chromium plating or the like for the prevention of a slip thereon. A groove may be provided in the peripheral portion of the first rotary member 4 at the nip point A so that the belt 3 is fitted in the groove.

The yarn Y is run while being supported under a prescribed tensile force between an upstream and a downstream feed rollers not shown in the drawings. The positions of the nip point A and the point B of crossing of the yarn Y are determined by those of an upstream and a downstream guides 7 and 8. The endless belt 3 and the first rotary member 4 are in contact with each other at the nip point A as shown in FIG. 2, and the yarn Y crossed with itself at the crossing point B on the peripheral surface of the second rotary member 5.

Figure 3A:
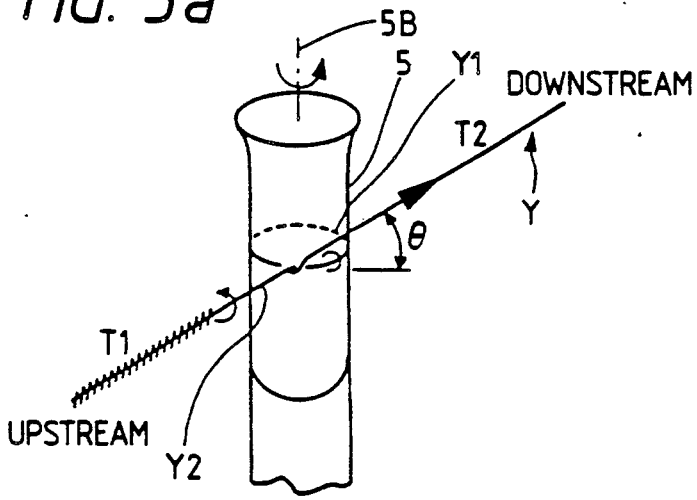
FIGS. 3*a*, 3*b*, 3*c* and 3*d* show twisting on a second rotary member.
Figure 3C:
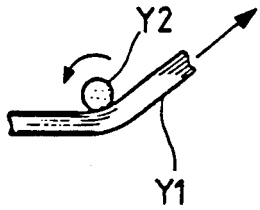
Figure 3B:
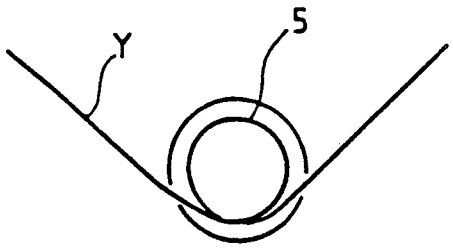
Figure 3D:
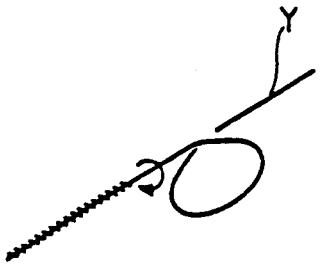

The twisting of the yarn Y by the second rotary member 5 is described with reference to FIG. 3. The axis 5B of rotation of the second rotary member 5 extends oblique to the direction of the running of the yarn Y, and the yarn is wound on the member at an angle $\theta$ thereto, as shown in FIG. 3*a*. The downstream portion Y1 of the yarn Y is wound on the second rotary member 5 counterclockwise with regard to FIG. 3*a* and crosses with the upstream portion Y2 of the yarn so that the top of the downstream portion is in contact with the bottom of the upstream portion. When the yarn Y is run, it would be moved down on the second rotary member 5. However, since the position of the path for the yarn Y is restricted, the yarn is rolled on the second rotary member 5 so that the yarn is twisted. The upstream portion Y2 of the yarn Y is rolled on the downstream portion Y1 thereof due to friction, as shown in FIG. 3*c*, so that the upstream portion is twisted in the same direction as the twisting of the yarn on the second rotary member 5. As a result, the twisting of the yarn Y due to the friction between the upstream and the downstream portions Y2 and Y1 and that of the yarn on the second rotary member 5 are added to each other. The upstream portion Y2 is thus subjected to S twisting. Since the main part of the twisting of the yarn Y is the twisting thereof due to the friction between the upstream and down stream portions thereof, the yarn is twisted to a large twist number of 1,000 TPM or more depending on the tension of the yarn. If the yarn Y is wound on a rotary member 5 clockwise with regard to FIG. 3*d*, the twisting of the yarn due to the friction between the upstream and downstream portions thereof and the twisting of the yarn on the rotary member are caused in the reverse directions to those of the above-mentioned twistings, so that the upstream portion is subjected to Z twist. The S twist and the Z twist can be changed for each other only by altering the direction of the winding of the yarn Y. The yarn Y is not necessarily run straight, but can be run to increase the angle of the winding thereof on the rotary member 5 as shown in FIG. 3*b*. The second rotary member 5 can rotate freely along with the running of the yarn Y, regardless of the free rotation or forced rotation of the first rotary member or the rotational frequency difference between them.

The operation of an embodiment is described with reference to FIG. 1. The yarn Y is twisted at the nip point A on the endless belt 3 and the first rotary member 4 so that the yarn undergoes Z twist upstream of the nip point. The portion Y2 of the yarn Y between the nip point A and the crossing point B on the second rotary member 5 undergoes S twist reverse to the Z twist. The portion Y1 of the yarn Y, which is located downstream of the crossing point B, is untwisted. The yarn Y is thus twisted, reversely twisted, and untwisted by the first and the second rotary members 4 and 5 continuously. The tension of the yarn Y is prevented from fluctuation due to a slip of the yarn with the increase in the speed of the yarn at the nip point A and the untwisting of the yarn in a high-speed processing area is stable. Twisting which corresponds to the fluctuation of the tension of the yarn Y is added so that the tension is uniformized. In other words, the untwisting is assisted depending on the untwisting tension of the yarn Y so that the untwisting in the high-speed processing area is stabilized.

Figure 4:
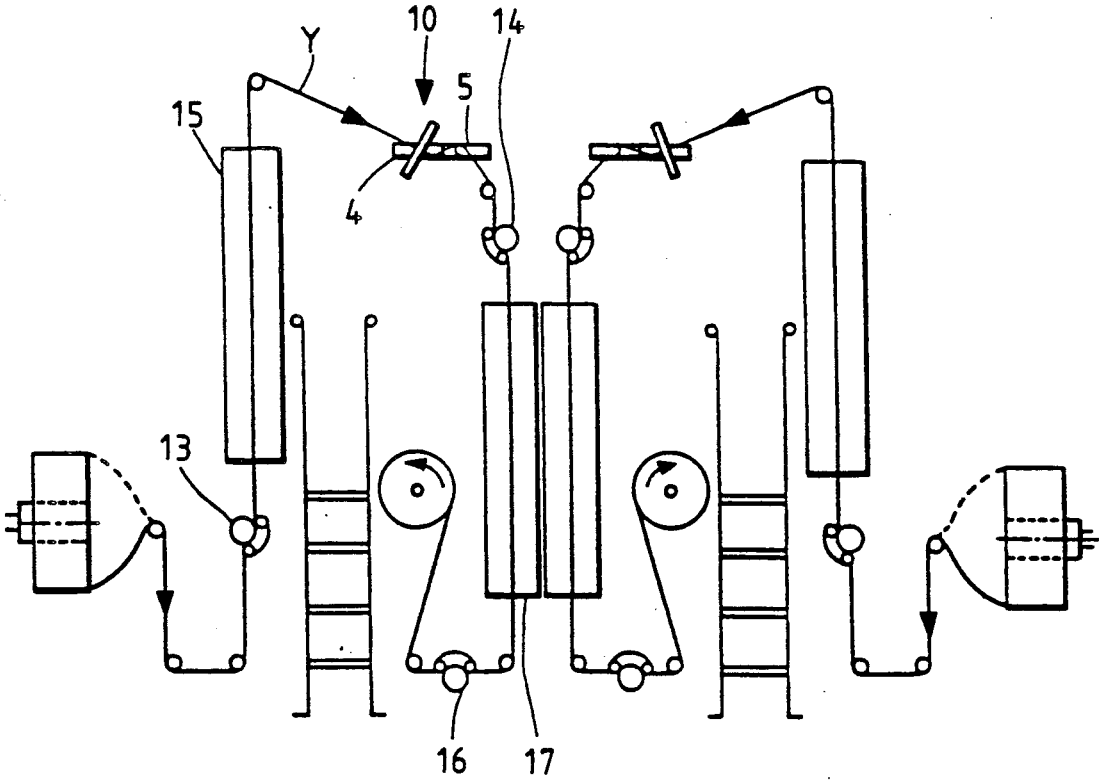
FIG. 4 shows the disposition of the components of an elongation false twisting machine employing the apparatus.
Figure 5:
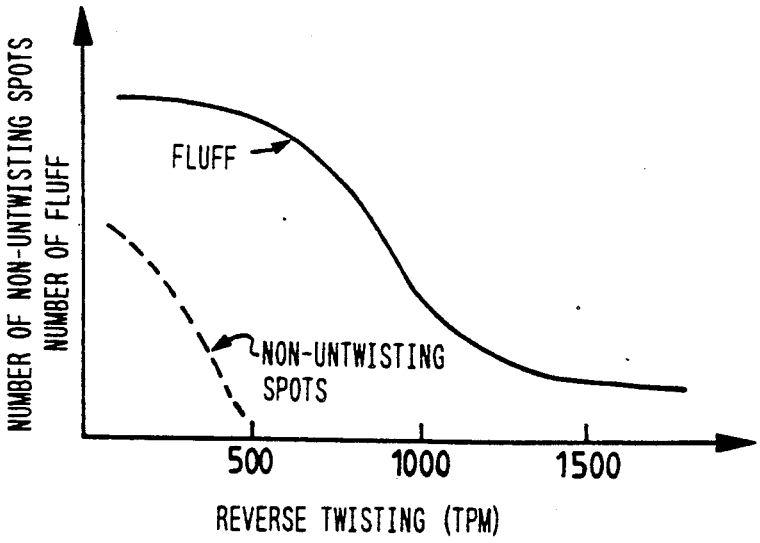
FIG. 5 is a graph indicating the relationship between the degree of reverse twisting and the number of pieces of fluff and that between the degree and the number of non-untwisting spots.
Figure 6:
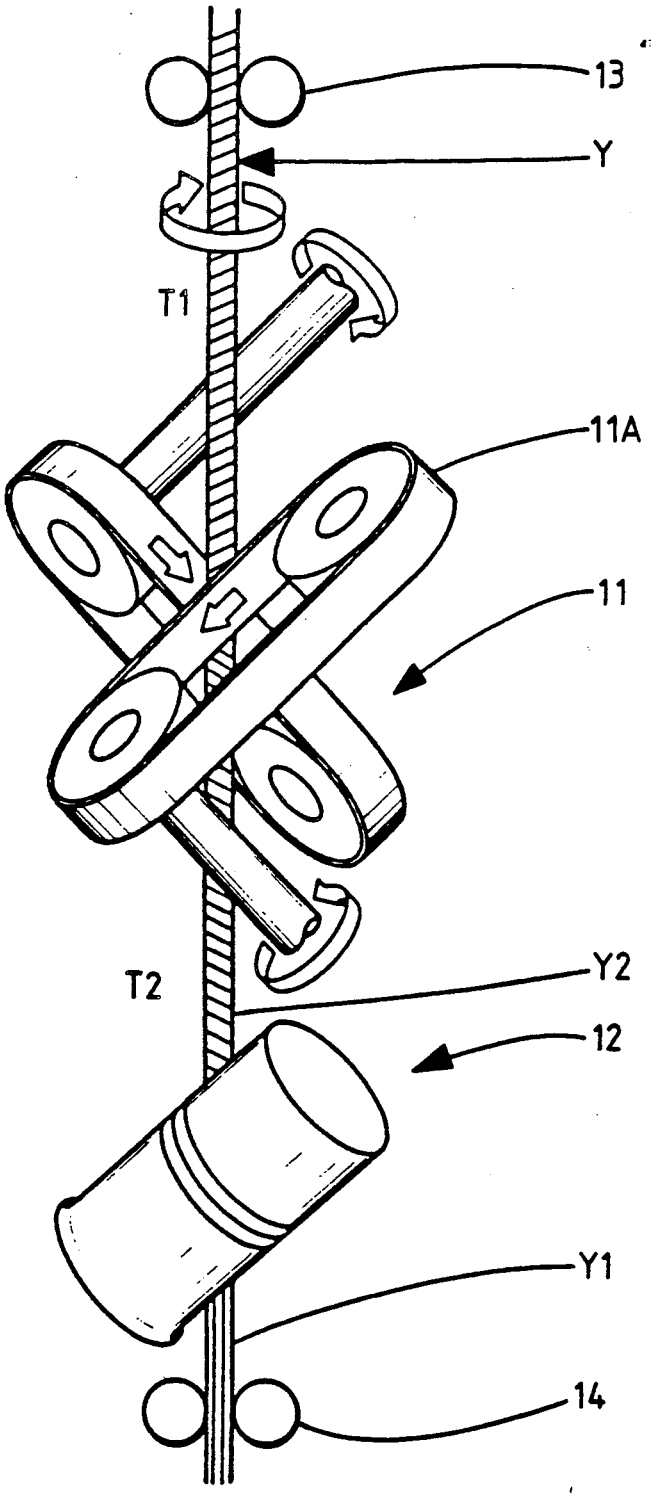
FIG. 6 PRIOR ART
FIG. 6 shows a conventional yarn twister.

An example of an elongation false twisting machine to which the yarn false twister described above is applied is described with reference to FIG. 4. The yarn Y is supported by an upstream feed roller 13 as a first feed roller and the downstream feed roller 14 as a second feed roller so that the yarn receives a prescribed tensile force by which the yarn can be elongated. The twister 10 is provided between the feed rollers 13 and 14 near the downstream feed roller so that the yarn Y is twisted upstream of the upstream feed roller by the apparatus. A heater 15 for the thermal fixing of the yarn Y is provided between the feed rollers 13 and 14 near the upstream feed roller. To heat the twisted yarn Y to the temperature for the elongation thereof, the heater 15 is made of a hot plate type or the like, in which the yarn is heated in contact with a hot plate whose temperature is accurately controlled by Downtherm vapor or the like. A third feed roller 16 is provided downstream of the second feed roller 14. A secondary heater 17 is provided between the second and the third feed rollers 14 and 16 so that the yarn Y already made bulky is reheated to reduce the elasticity but maintains the bulkiness thereof. However, the secondary heater 17 is not always needed, but can be put into action depending on the kind of the yarn. Since the twisting, the reverse twisting and the untwisting are continuously performed by the first and the second rotary members 4 and 5 integrally coupled with each other, the constitution of the false twister 10 is compact and it is easy to engage the yarn thereon. It is preferable that the degree of the reverse twisting is 1,000 TPM or more. Fluff, which is a state in which one of the filaments of the yarn is cut off, decreases sharply up to 1,000 TPM of the reverse twisting and decreases slowly above it, as shown in FIG. 5 indicative of the results of a test conducted on the yarn under such conditions as to make it relatively likely to generate the fluff or the like. For that reason, it is preferable that the degree of the reverse twisting is set at 1,000 TPM or more to make it possible to establish the high-speed processing area. A non-untwisting spot, which is a state in which the untwisting of the yarn is nonuniform, does not occur above 500 TPM of the untwisting. These trends do not depend on the number (which is several thousands in TPM) of the twists at the nip point but are nearly unchanged.

In a false twister for a yarn provided in accordance with the present invention, an endless belt and a first rotary member are disposed across each other to constitute a nip point at which a yarn is twisted. A second rotary member, on which the yarn is wound after the nipping thereof so that the upstream and downstream portions of the wound yarn cross in contact with each other, is provided coaxially with the first rotary member so that the second rotary member can be rotated independently of the first rotary member. Since the twisting, reverse twisting and untwisting of the yarn are continuously performed by the integrated device, the constitution thereof is compact, the restrictions on the installation space for the apparatus are reduced and the yarn can be continuously engaged thereon.

What is claimed is:

1. A false twister for a yarn, comprising:

an endless belt opposingly arranged with a first rotary member, the endless belt and first rotary member creating a nip point at which the yarn is nipped, a shaft for rotatably supporting the first rotary member, and a second rotary member, on which the yarn is wound after being nipped, wherein the yarn includes portions upstream and downstream of the second rotary member, the yarn being wound on the second rotary member so that the upstream and downstream portions of the yarn cross in contact with each other, wherein the second rotary member is supported by the shaft and is provided coaxially with the first rotary member so that the second rotary member can be rotated independently of the first rotary member.

2. A false twister for a yarn as claimed in claim 1, including an upstream guide for guiding the yarn to the nip point of the endless belt and the first rotary member, and a downstream guide for regulating a crossing point of the upstream and downstream portions of the yarn on a peripheral surface of the second rotary member.

3. A false twister for a yarn as claimed in claim 2, wherein the first rotary member and the second rotary member rotate freely.

4. A false twister for a yarn as claimed in claim 2, wherein the first rotary member is positively rotated by a driving means, while the second rotary member rotates freely.

5. A false twister for a yarn as claimed in claim 1, wherein surfaces of the first and the second rotary members are processed for prevention of a slip of the yarn thereon.

6. A false twister for a yarn as claimed in claim 1, a belt is fitted in a groove which is provided in a peripheral portion of the first rotary member of the nip point.

7. A draw false twisting machine comprising:

an upstream feed roller and a downstream feed roller for supporting a yarn so that the yarn receives a prescribed tensile force by which the yarn can be elongated, a false twister, disposed between the upstream and downstream feed rollers, for providing a false twist to the yarn, a heater, disposed between the upstream and downstream feed rollers, for thermally fixing the yarn. wherein the false twister includes an endless belt and a first rotary member opposingly arranged so as to create a nip point at which the yarn is nipped, the first rotary member being rotatably supported by a shaft; and a second rotary member on which the yarn is wound after the nipping thereof so that portions of the yarn cross in contact with each other on a surface of the second rotary member, the second rotary member being supported by a shaft and being provided coaxially with the first rotary member so that the second rotary member can be rotated independently of the first rotary member.

* * * * *